United States Patent [19]

Porps et al.

[11] Patent Number: 4,609,070

[45] Date of Patent: Sep. 2, 1986

[54] FIREWOOD CUTTING SUPPORT

[76] Inventors: Thomas A. Porps, 501 Indian Point Rd., Twin Lakes, Wis. 53181; James A. Augustyn, 612 Virginia St., Antigo, Wis. 54409

[21] Appl. No.: 616,590

[22] Filed: Jun. 4, 1984

[51] Int. Cl.[4] ..... B27B 21/00

[52] U.S. Cl. ..... 182/18; 182/129; 182/181; 269/296; 269/902

[58] Field of Search ..... 182/224, 18, 129, 181–184; 269/296, 300, 902

[56] References Cited

U.S. PATENT DOCUMENTS 4,454,929 6/1984 Wellman ..... 182/181

*Primary Examiner*—Reinaldo P. Machado

*Attorney, Agent, or Firm*—Dorsey & Whitney

[57] ABSTRACT

A firewood cutting support for cutting a piece of firewood stock into pieces of desired length including a plurality of cross braces spaced from one another a distance approximately equal to the desired length of firewood pieces being cut and an end cross brace spaced from an end one of the plurality of cross brace. The support insures that pieces of firewood will be cut into desired lengths and prevents the pieces from binding against the saw blade. The support also insures that the log will not require repositioning during any of the cutting operations.

8 Claims, 3 Drawing Figures

FIREWOOD CUTTING SUPPORT

BACKGROUND OF THE INVENTION

The present invention relates generally to a support for cutting firewood, and more particularly, to a firewood cutting support or sawbuck for cutting uncut firewood stock into pieces of desired lengths.

Uncut firewood stock is normally supplied in six or eight foot lengths. These lengths are first cut into pieces of desired length, normally 16 inches or 24 inches, with a chain saw or other similar cutting device. The pieces are then split with an axe or maul to the desired firewood size. In some instances, the firewood stock is cut into smaller pieces by laying the log on the ground and cutting the same with a chainsaw. Such an operation, normally provides no means for cutting the log into pieces of exact desired length. Further, because the entire log is supported, the cut piece cannot fall away from the saw during the cutting operation; thus, the saw tends to bind in the saw kerf as the cut is being made. Additionally, the saw sometimes will contact the ground near the end of the cutting operation, thereby causing the saw to become dull.

In other firewood cutting operations, the piece of uncut firewood stock is supported by a sawbuck or other means. This permits the person cutting the firewood to stand upright and prevents the saw from contacting the ground during the cutting operation. These sawbucks commonly consist of a pair of end braces which form a v-shaped notch to support the log at two points. Most fail to include means for insuring that the firewood is cut into pieces of desired length or means for preventing the log from binding against the saw during the cutting operation.

One prior art structure which does provide a means for insuring that the log is cut into accurate and desired lengths is shown in U.S. Pat. No. 4,325,543 issued to York. This structure includes a plurality of log holders which are spaced from each other a distance corresponding to the desired lengths into which the firewood is to be cut. Each of these holders includes a pair of holder members which are spaced from one another to function as a guide for the saw. In using the device of York, several pieces of uncut firewood stock are placed in the sawbuck and cut simultaneously by passing the saw through the saw guide. After these cuts are made, the logs must then be removed from the sawbuck and new logs put in their place. No means is provided in this structure for preventing the saw from binding within the saw kerf during a cutting operation.

Accordingly, there is a need in the art for a support for cutting firewood which not only insures that each of the firewood pieces is cut to the desired length, but also insures that the pieces being cut do not bind against the saw blade during the cutting operation.

SUMMARY OF THE INVENTION

Contrary to the prior art, the present invention relates to a firewood cutting support which insures that the firewood is cut into pieces of desired length. The structure of the present invention also prevents the log from binding against the saw during the cutting operation. Additionally, the apparatus of the present invention is designed so that the pieces of firewood which are cut automatically fall away from the saw at the end of each cutting operation.

More specifically, the structure of the present invention includes a plurality of cross braces or struts which are retained in spaced relationship from one another by a pair of connecting struts. Each of these cross braces or struts are spaced from each other at their centers a distance corresponding to the desired length of the cut firewood pieces. Disposed at one end of the structure is an additional cross brace or strut which is spaced a lesser distance from its adjacent cross brace. Specifically, this additional cross brace is spaced approximately one-half to three-fourths of the distance between the other cross braces.

In the preferred embodiment, a pair of measuring guides are connected to the upper end of the end braces to indicate where the log of uncut firewood stock is to be positioned and cut. Because of the positioning of the cross braces, and particularly the positioning of the end brace which is closer to its adjacent brace than the others, the pieces of firewood which are cut will fall away from the saw during the cutting operation. This prevents the logs from binding against the sawblade.

Accordingly, it is an object of the present invention to provide an improved firewood cutting support which insures that all of the pieces of cut firewood are the same length.

Another object of the present invention is to provide an improved firewood cutting support which prevents the log from binding against the sawblade during the cutting operation.

Another object of the present invention is to provide an improved firewood cutting support having means for insuring proper placement of the uncut firewood stock in the support prior to commencing the cutting operation.

A further object of the present invention is to provide an improved firewood cutting support in which the log will not require repositioning during any of the cutting operations.

These and other objects will become apparent with reference to the drawings, the description of the preferred embodiment and the appended claims.

DESCRIPTION OF THE PREFERRED EMBODIMENT

Figure 1:
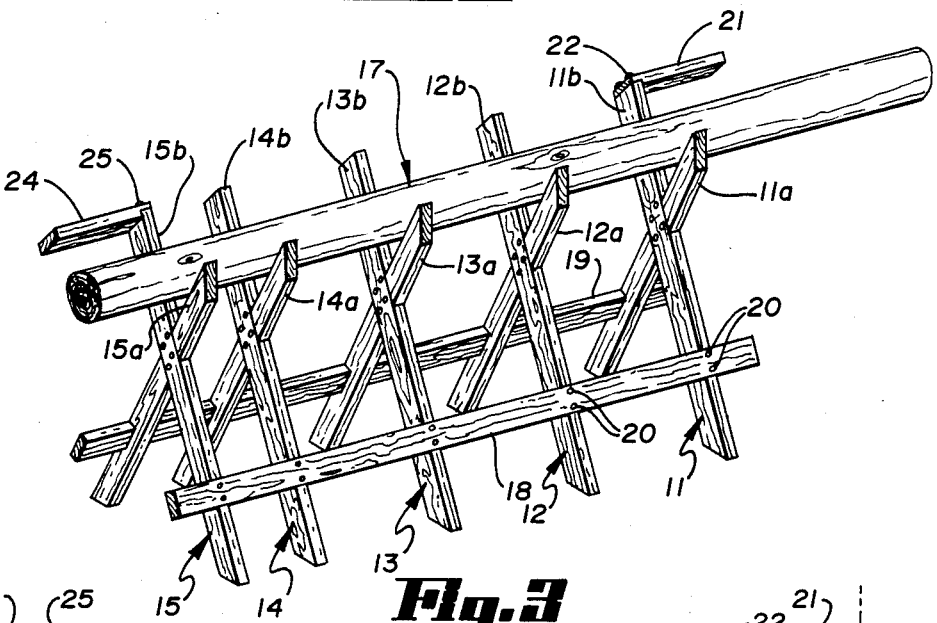
FIG. 1 is a pictorial view of the firewood cutting support of the present invention with an uncut log of firewood stock placed in position for cutting.
Figure 3:
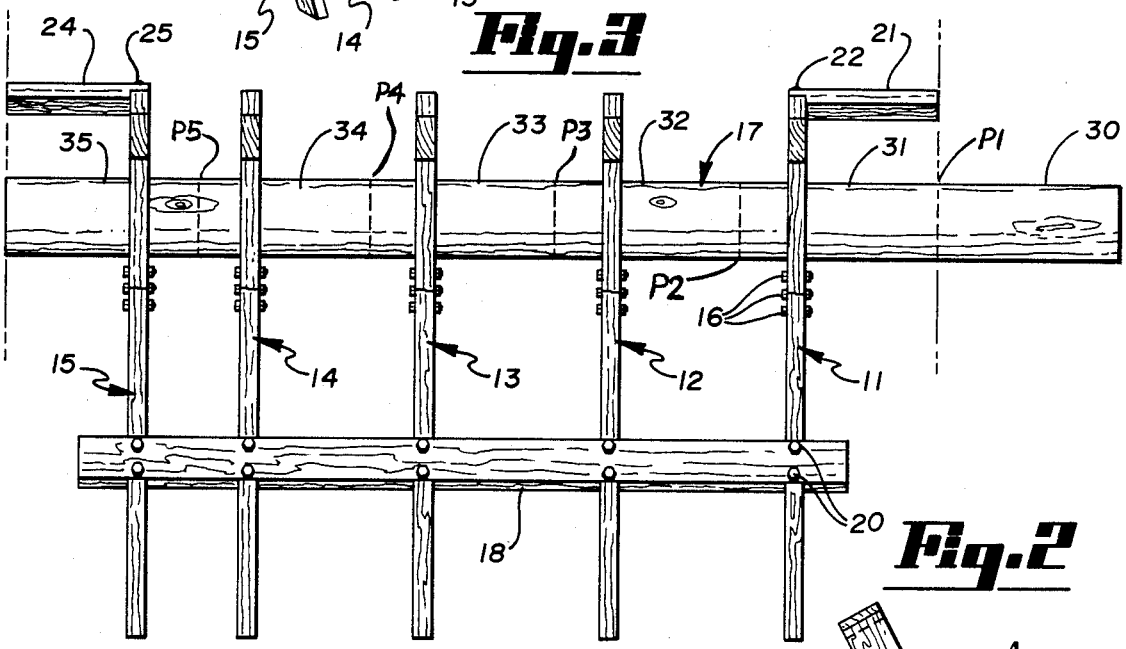
FIG. 3 is a side elevational view of the firewood cutting support of the present invention with an uncut log of firewood stock placed in position for cutting.
Figure 2:
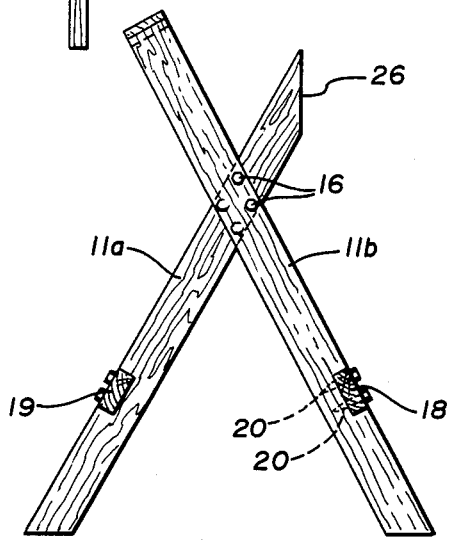
FIG. 2 is an end elevational view of the firewood cutting support of the present invention.

With reference to FIGS. 1, 2 and 3, the firewood cutting support of the present invention includes a plurality of cross braces or cross struts 11, 12, 13, 14 and 15. Each of these struts is comprised of a pair of brace elements including brace elements 11*a*, 12*a*, 13*a*, 14*a*, 15*a* and corresponding brace elements 11*b*, 12*b*, 13*b*, 14*b*, 15*b*. The brace elements 11*a*–15*a* and their corresponding brace elements 11*b*–15*b* are connected together by a plurality of carriage bolts 16 or other appropriate connecting means. In the preferred embodiment, each of the brace elements 11*a*–15*a* and 11*b*–15*b* are notched in the area where they engage their corresponding brace element so that a half lap structure is formed.

In the preferred embodiment, each of the brace elements 11a–15a is shorter than its corresponding brace element 11b–15b and is cut so that it exposes a front face 26 which is generally vertical. This gives the user additional room within which to operate and prevents interference during the cutting operation. The preferred structure contemplates the cross brace elements 11a–15a and 11b–15b to be constructed from common 2×4 stock having a cross sectional dimension of 1½ by 3½ inches.

Each of the cross braces 11–15 is spaced from one another and retained in such spaced relationship by a pair of connecting struts 18 and 19. In the preferred embodiment, the connecting strut 18 is connected with each of the brace elements 11b–15b near their lower ends, while the connecting strut 19 is connected with each of the brace elements 11a–15a near their lower ends. Although the connecting struts 18 and 19 can be bolted or otherwise connected directly to the upwardly facing surfaces of the connecting struts 11a–15a and 11b–15b, in the preferred embodiment, notches are formed in each of the strut elements 11a–15a and 11b–15b for seating of the connecting struts 18 and 19. The connecting struts 18 and 19 are then secured within these notches by lag screws 20, 20. Similar to the brace elements 11a–15a and 11b–15b, the struts 18 and 19 are constructed from common 2×4 stock.

As illustrated best in FIGS. 1 and 3, the cross struts 11, 12, 13 and 14 are spaced from one another along their centerlines a distance approximately equal to the desired length of the cut wood. For example, if it is desired to cut the wood into sixteen inch lengths the distance between the centerlines of adjacent cross braces would be approximately sixteen inches. The end cross brace 15 is spaced from the cross brace 14 a distance significantly less than the others. For example, if the wood is desired to be cut into sixteen inch pieces, the end cross brace 15 in the preferred embodiment would be spaced from the cross brace 14 a distance of six to ten inches. The distance between the centerlines of the end cross brace 15 and its adjacent cross brace 14 must be short enough to permit the end log piece to fall away from the saw upon completion of the last saw cut. Therefore, such distance should be less than three-fourths of the desired firewood length and preferably between one third and three-fourths of the desired firewood length.

Connected to the upper ends of each of the end brace elements 11b and 15b is a measuring guide 21 and 24, respectively. The measuring guide 24 is connected to the upper end of the brace element 15b by the lag bolt or other connecting member 25 in the manner illustrated in FIGS. 1 and 3, while the measuring guide 21 is connected to the upper end of the brace element 11b by the lag bolt or other connecting member 22. The purpose of the measuring guide 24 is to define the position at which the uncut firewood stock 17 is to be placed in the log support, while the function of the measuring guide 21 is to define the position of the first cut. Specifically, when a log 17 is placed into the support, one end is aligned with the outer end of the measuring guide 24 as shown in FIGS. 1 and 3. If it is an eight foot length of firewood stock, the other end of the log 17 would extend past the outer end of the measuring guide 21 of the present structure by a distance of sixteen inches. Thus the distance between the outer ends of the guides 21 and 24 in the preferred embodiment would be about eighty inches.

During use of the firewood cutting support of the present invention, a piece of uncut firewood stock 17 is placed onto the support in the manner described above. This involves aligning one end of the log 17 with the other end of the guide member 24. If the stock is eight feet long, as most of them are, the first cut is made at the point P1 which is aligned with the outer end of the measuring guide 21. Thus, the first piece 30 which is cut from the log is sixteen inches long. The subsequent cuts of the log 17 are then made about three inches (or some other specified distance determined by the specific support structure) from each of the cross braces 11, 12, 13 and 14. For example, the second cut is made at the point P2. This cut will result in a firewood piece of 16 inches. During this cut, the weight of the piece 31 extending to the right hand side of the cross brace 11 will open the saw kerf, thus precluding binding against the saw blade. At the completion of the cut, the cut piece of firewood 31 will pivot with respect to the cross brace 11 and fall from the log 17 onto the ground.

The third cut is made at the point P3, again about three inches or some other designated distance from the cross brace 12. As the cut is made, the weight of the piece 32 being cut will open the saw kerf and prevent binding. At the conclusion of the third cut the piece 32 will pivot with respect to the cross brace 12 and fall onto the ground. The fourth cut is done at the point P4 in a similar way. The position of the fifth cut will be determined by the distance between the cross braces 14 and 15. In the preferred embodiment the saw is positioned at the point P5 approximately three inches from the cross brace 14. During this cut, there will be weight on the outside of both the cross braces 14 and 15, thereby opening the saw kerf and preventing binding against the saw. At the completion of the cut, both logs will fall off in opposite directions onto the ground. A second log of uncut firewood stock can then be placed in the support and the process repeated. It has been found that the above apparatus greatly simplifies the cutting of firewood and insures logs of the same length on every cut. The structure of the present invention also prevents binding of the logs against the saw blade.

It is also possible to vary the distance between the cross braces 13 and 14. If this is done, the position of the fifth cut must also be adjacent. For example, in one embodiment, the cross brace 14 is positioned one inch closer to cross brace 13. In this structure the fifth cut must be made four inches from the cross brace 14, assuming the other cuts were made three inches from their respective cross braces. This latter embodiment is preferable if the distance between the centerlines of cross braces 14 and 15 is nine and one-half inches. In this structure, the fifth cut can then be made midway between the cross braces 14 and 15.

Although the description of the preferred embodiment has been quite specific, it is contemplated that various modifications could be made without deviating from the spirit of the present invention. Accordingly, it is contemplated that the scope of the present invention be dictated by the appended claims rather than by the description of the preferred embodiment.

We claim:

1. A firewood cutting support for cutting a piece of firewood stock into pieces of desired length by starting at one end of said firewood stock and sequentially cutting firewood pieces from said one end until the final cut is made comprising:

at least three cross braces each including a pair of brace elements secured to one another at a point between their ends to form a crossed configuration having a v-notch for supporting a piece of firewood stock, said cross braces being equally spaced from one another along their centerlines a first distance approximately equal to the desired length of the firewood pieces being cut, said first distance being approximately sixteen inches, the spacing of said cross braces permitting the saw kerf to open as cuts are made;

an end cross brace including a pair of brace elements secured to one another at a point between their ends to form a crossed configuration having a V-notch for supporting a piece of firewood stock, said end cross brace being spaced from an end one of said cross braces along their centerlines by a second distance no greater than three-fourths and no less than one-third of the desired length of the firewood pieces being cut, said second distance being no greater than about twelve inches and no less than about six inches, the spacing between said end brace and said one cross brace permitting the final cut to be made approximately midway between said end brace and said one cross brace and further permitting the saw kerf to open as said final cut is made; and connection means for retaining said plurality of cross braces and said end cross brace in the above spaced relationship, whereby when a piece of firewood stock is placed on the cutting support and said stock is sequentially cut starting with the end opposite said end brace, with each such cut being made to the side of the center point between each pair of cross braces opposite said end brace and with the final cut being made approximately midway between said end brace and the cross brace to which it is adjacent, the weight of each firewood piece being cut will tend to open the saw kerf as such cut is made.

2. The support of claim 1 wherein said end cross brace is spaced from an end one of said plurality of cross braces a distance of between eight inches and ten inches.

3. The support of claim 1 wherein said plurality of cross braces and said end cross brace are constructed of common 2×4 stock.

4. The support of claim 1 wherein said connection means comprises a pair of elongated members connected respectively to the brace elements of said plurality of cross braces and said end cross brace.

5. The support of claim 3 wherein said connection means is constructed of common 2×4 stock.

6. The support of claim 1 wherein said plurality of cross braces includes four cross braces.

7. A firewood cutting support for cutting a piece of firewood stock into pieces of desired length by starting at one end of said firewood stock and sequentially cutting firewood pieces from said one end until the final cut is made comprising:

at least three cross braces each including a pair of brace elements secured to one another at a point between their ends to form a crossed configuration having a v-notch for supporting a piece of firewood stock, said cross braces being spaced from one another along their centerlines a distance approximately equal to the desired length of the firewood pieces being cut, the spacing of said cross braces permitting the saw kerf to open as cuts are made;

an end cross brace including a pair of brace elements secured to one another at a point between their ends to form a crossed configuration having a v-notch for supporting a piece of firewood stock, said end cross brace being spaced from an end of one of said cross braces along their centerlines by a distance no greater than three-fourths and no less than one-third of the desired length of the firewood pieces being cut, the spacing between said end brace and said one cross brace permitting the final cut to be made approximately midway between said end brace and said one cross brace and further permitting the saw kerf to open as said final cut is made;

connection means for retaining said plurality of cross braces and said end cross brace in the above spaced relationship; and a first measuring guide connected with said end cross brace and extending outwardly therefrom to define the end position of said firewood stock.

8. The support of claim 7 including a second measuring guide connected with the end one of said plurality of cross braces opposite said end cross brace, said second measuring guide extending outwardly therefrom to define the position of the first saw cut.

* * * * *